US009482188B2

(12) United States Patent
Sasaki et al.

(10) Patent No.: US 9,482,188 B2
(45) Date of Patent: Nov. 1, 2016

(54) VALVE APPARATUS

(71) Applicant: DENSO CORPORATION, Kariya, Aichi-pref. (JP)

(72) Inventors: Kazushi Sasaki, Obu (JP); Osamu Shimane, Kariya (JP)

(73) Assignee: DENSO CORPORATION, Kariya (JP)

( * ) Notice: Subject to any disclaimer, the term of this patent is extended or adjusted under 35 U.S.C. 154(b) by 130 days.

(21) Appl. No.: 14/321,111

(22) Filed: Jul. 1, 2014

(65) Prior Publication Data

US 2015/0007801 A1 Jan. 8, 2015

(30) Foreign Application Priority Data

Jul. 3, 2013 (JP) ..... 2013-139555
Apr. 3, 2014 (JP) ..... 2014-076826

(51) Int. Cl.
*F02M 25/07* (2006.01)

(52) U.S. Cl.
CPC ..... *F02M 25/0756* (2013.01); *F02M 26/48* (2016.02); *F02M 26/54* (2016.02); *F02M 2026/001* (2016.02)

(58) Field of Classification Search
CPC ..... F02M 25/0773; F02M 25/0756; F02M 25/0794; F02M 25/0722; F02D 41/0077; F02D 2011/102; F02D 2250/16; F02D 9/1065; F02D 11/10; F02D 9/105; F16K 1/2263; F16K 1/2266
USPC ..... 123/568.23, 568.24, 568.29, 399, 337, 123/396, 403, 90.11; 251/129.01–129.22, 251/305; 701/101–104
See application file for complete search history.

(56) References Cited

U.S. PATENT DOCUMENTS 7,036,486 B2 * 5/2006 Kamimura ..... F02D 9/105 123/337
7,143,743 B2 * 12/2006 Uda ..... F02D 9/1095 123/399
7,234,444 B2 * 6/2007 Nanba ..... F02D 9/1045 123/337
7,950,623 B2 * 5/2011 Sasaki ..... F02D 41/0077 251/129.04
8,122,873 B2 * 2/2012 Furukawa ..... F02M 26/26 123/568.12
2006/0107923 A1 * 5/2006 Kusatsugu ..... F02D 9/02 123/399

(Continued)

FOREIGN PATENT DOCUMENTS

JP 2000-154754 6/2000
JP 2009-036108 2/2009

OTHER PUBLICATIONS

Office Action (2 pages) dated Aug. 4, 2015, issued in corresponding Japanese Application No. 2014-076826 and English translation (4 pages).

*Primary Examiner* — Lindsay Low
*Assistant Examiner* — Long T Tran
(74) *Attorney, Agent, or Firm* — Nixon & Vanderhye P.C.

(57) ABSTRACT

A control device executes a feedback control operation of an electric motor such that a sensed opening degree of a valve approaches a target opening degree, which is set for a time of fully closing the valve. The control device stops the energization of the electric motor after reaching of the sensed opening degree of the valve to an energization stop opening degree, which is set on a valve opening side of a full closing degree of the valve in a valve opening direction of the valve. A return spring urges the valve in a valve closing direction of the valve. The target opening degree is set on a valve closing side of the energization stop opening degree in the valve closing direction.

4 Claims, 4 Drawing Sheets

(56) References Cited

U.S. PATENT DOCUMENTS

2007/0095334 A1* 5/2007 Nanba ..... F02D 9/1045
123/568.24
2007/0240677 A1* 10/2007 Sasaki ..... F16K 1/221
123/337
2010/0089370 A1* 4/2010 Furukawa ..... F02M 26/26
123/568.12
2011/0273127 A1* 11/2011 Imamura ..... F02D 41/1497
318/650
2013/0047941 A1* 2/2013 Niwa ..... F02D 9/1065
123/90.11
2013/0313460 A1 11/2013 Kobayashi

* cited by examiner

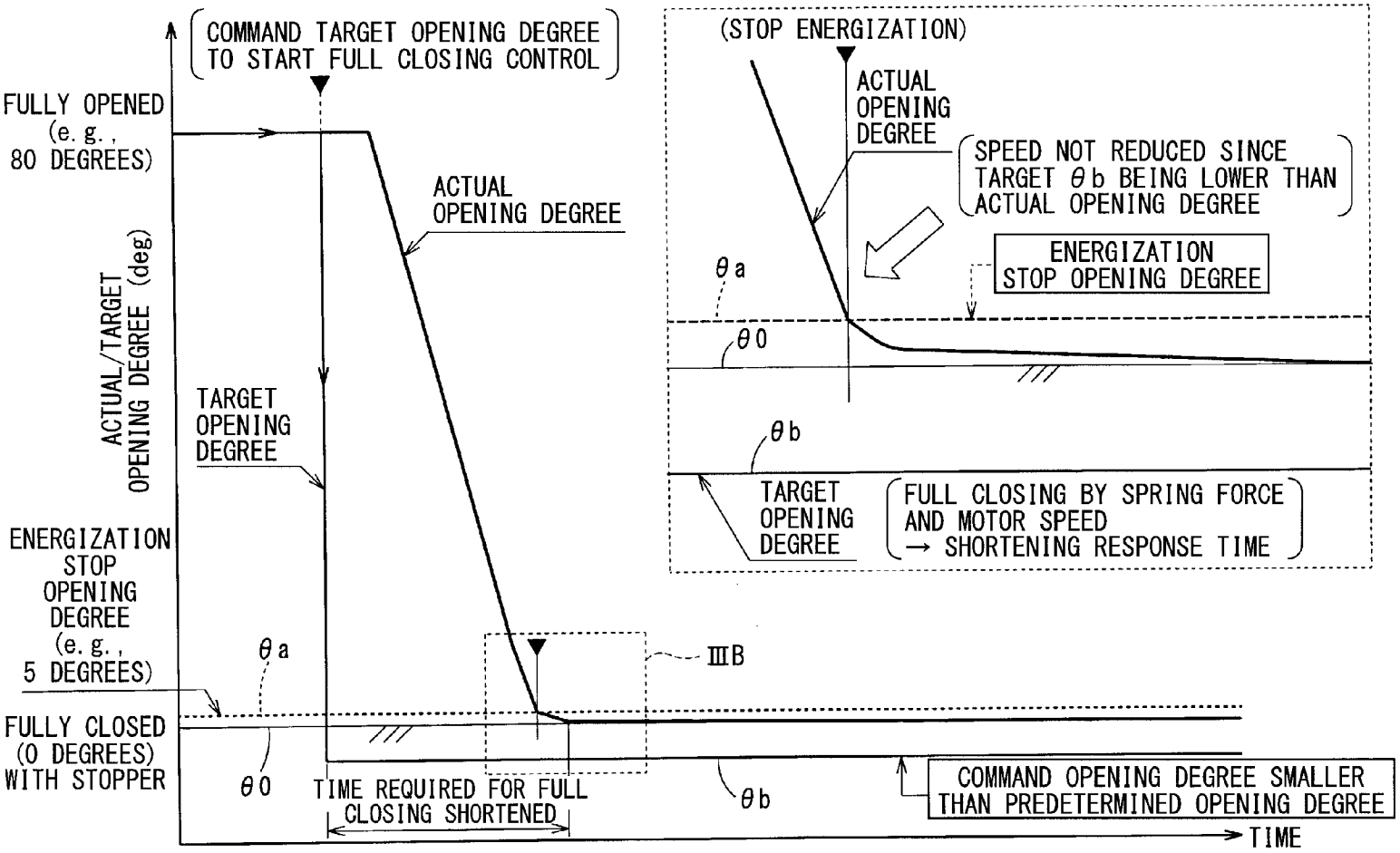
FIG. 3A
COMMAND TARGET OPENING DEGREE TO START FULL CLOSING CONTROL
ACTUAL OPENING DEGREE
TARGET OPENING DEGREE
FULLY OPENED (e.g., 80 DEGREES)
ACTUAL/TARGET OPENING DEGREE (deg)
ENERGIZATION STOP OPENING DEGREE (e.g., 5 DEGREES)
FULLY CLOSED (0 DEGREES) WITH STOPPER
θa
θ0
θb
IIIB
TIME REQUIRED FOR FULL CLOSING SHORTENED
COMMAND OPENING DEGREE SMALLER THAN PREDETERMINED OPENING DEGREE
TIME
FIG. 3B
(STOP ENERGIZATION)
ACTUAL OPENING DEGREE
SPEED NOT REDUCED SINCE TARGET θb BEING LOWER THAN ACTUAL OPENING DEGREE
ENERGIZATION STOP OPENING DEGREE
FULL CLOSING BY SPRING FORCE AND MOTOR SPEED → SHORTENING RESPONSE TIME
TARGET OPENING DEGREE

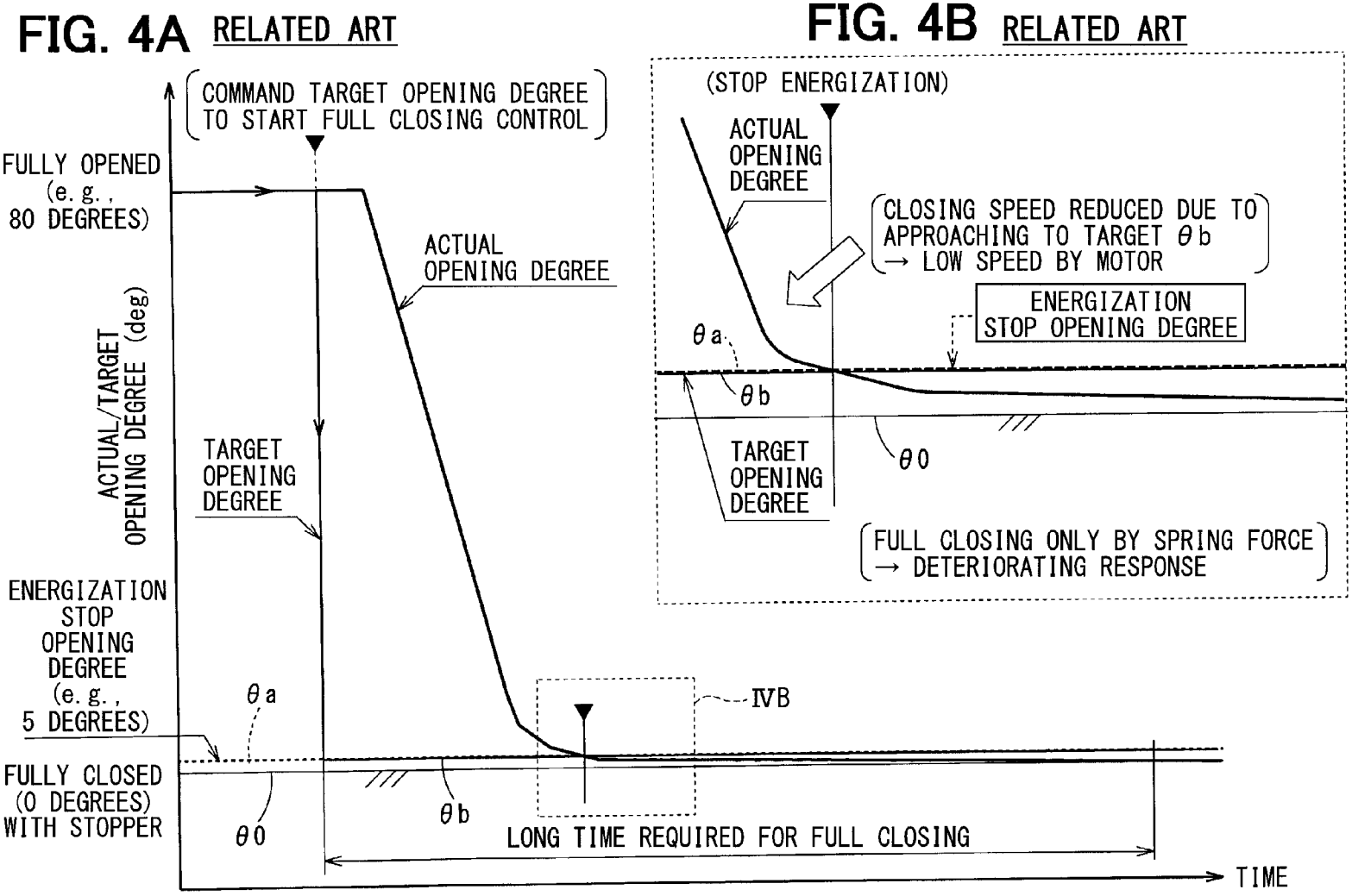
FIG. 4A RELATED ART
COMMAND TARGET OPENING DEGREE TO START FULL CLOSING CONTROL
ACTUAL OPENING DEGREE
TARGET OPENING DEGREE
FULLY OPENED (e.g., 80 DEGREES)
ACTUAL/TARGET OPENING DEGREE (deg)
ENERGIZATION STOP OPENING DEGREE (e.g., 5 DEGREES)
FULLY CLOSED (0 DEGREES) WITH STOPPER
θa
θb
θ0
IVB
LONG TIME REQUIRED FOR FULL CLOSING
TIME
FIG. 4B RELATED ART
(STOP ENERGIZATION)
ACTUAL OPENING DEGREE
CLOSING SPEED REDUCED DUE TO APPROACHING TO TARGET θb → LOW SPEED BY MOTOR
ENERGIZATION STOP OPENING DEGREE
TARGET OPENING DEGREE
FULL CLOSING ONLY BY SPRING FORCE → DETERIORATING RESPONSE

VALVE APPARATUS

CROSS REFERENCE TO RELATED APPLICATION

This application is based on and incorporates herein by reference Japanese Patent Application No. 2013-139555 filed on Jul. 3, 2013 and Japanese Patent Application No. 2014-076826 filed on Apr. 3, 2014.

TECHNICAL FIELD

The present disclosure relates to a valve apparatus.

BACKGROUND

For example, JP2009-036108A discloses an exhaust gas recirculation (EGR) apparatus as a valve apparatus that has an electric actuator, which drives a valve and is controlled by a control device.

In the EGR apparatus of JP2009-036108A, an electric motor of the electric actuator is feedback controlled with the control device such that a sensed opening degree (an actual opening degree), which is sensed with an opening degree sensor, coincides with a target opening degree of the valve, which is set according to a target EGR ratio.

The measures, which reduce a time required for fully closing the valve at the time of fully closing the valve in the valve open state, may include an energization control operation of the electric motor in the valve closing direction. At the time of executing the energization control operation, when the mechanical stopper makes strong abutment (collision) at a full closing degree θ0 of the valve, a collision sound may be generated, and/or damage may occur due to the collision.

In order to avoid the mechanical collision of the mechanical stopper, the valve closing speed of the valve needs to be reduced immediately before the full closing degree θ0.

As shown in FIG. 4A, the measures, which avoid the mechanical collision of the mechanical stopper, may include (i) controlling energization of the electric motor in the valve closing direction until reaching of the sensed opening degree to an energization stop opening degree θa, which is set on a valve opening side of the full closing degree θ0, and (ii) stopping the energization of the electric motor after reaching of the sensed opening degree to the energization stop opening degree θa, and returning the valve to the full closing degree θ0 only by the urging force of the return spring.

However, in the case where the energization stop opening degree θa is set as the target opening degree θb, which is set for the time of fully closing the valve, when the valve opening degree approaches the energization stop opening degree θa, the closing speed of the valve is reduced by the feedback control, as shown in FIG. 4B. Specifically, the closing speed of the valve is largely reduced immediately before the energization stop opening degree θa, so that the speed reducing time is required before the time of reaching to the energization stop opening degree θa.

Furthermore, after the stopping of the energization of the electric motor, the valve, the speed of which is sufficiently reduced, is closed only by the urging force of the return spring that has the reduced restoring force. Therefore, the time, which is from the energization stop opening degree θa to the full closing degree θ0, is lengthened.

Even when the energization control of the electric motor in the valve closing direction is made to reduce the time required for fully closing the valve, the closing speed of the valve is reduced immediately before the energization stop opening degree θa by the feedback control, and the valve, the speed of which is sufficiently reduced, is fully closed only by the urging force of the return spring. Therefore, the response of the valve at the time of fully closing the valve is deteriorated.

SUMMARY

The present disclosure is made in view of the above disadvantage.

According to the present disclosure, there is provided a valve apparatus that includes a valve, an opening degree sensor, an electric actuator, a control device, a return spring, and a mechanical stopper. The valve is closable. The valve opens or closes a passage. The opening degree sensor senses an opening degree of the valve. The electric actuator drives the valve with an electric motor, which generates a rotational output when the electric motor is energized. The control device executes a feedback control operation of the electric motor such that when the valve, which is in a valve open state, is fully closed, a sensed opening degree of the valve, which is sensed with the opening degree sensor, approaches a target opening degree, which is set for a time of fully closing the valve. The control device stops the energization of the electric motor after reaching of the sensed opening degree of the valve, which is sensed with the opening degree sensor, to an energization stop opening degree, which is set on a valve opening side of a full closing degree of the valve in a valve opening direction of the valve. The return spring urges the valve in a valve closing direction of the valve. The mechanical stopper mechanically stops the valve at the full closing degree. The target opening degree, which is set for the time of fully closing the valve, is set on a valve closing side of the energization stop opening degree in the valve closing direction.

BRIEF DESCRIPTION OF THE DRAWINGS

The drawings described herein are for illustration purposes only and are not intended to limit the scope of the present disclosure in any way.

FIG. 3A is a diagram for describing an operation of fully closing a valve in a valve open state according to the embodiment;

FIG. 3B is a partial enlarged view of an area IIIB in FIG. 3A;

FIG. 4A is a diagram for describing an operation of fully closing a valve in a valve open state in a related art; and FIG. 4B is a partial enlarged view of an area IVB in FIG. 4A.

DETAILED DESCRIPTION

An embodiment of the present disclosure will be described with reference to the accompanying drawings.

A specific example, in which a principle of the present disclosure is applied to an exhaust gas recirculation (EGR) apparatus, will be described. It should be noted that the following embodiment is a mere example of the present disclosure, and the present disclosure is not limited to the following embodiment.

The EGR apparatus is a known technique and recirculates a portion of exhaust gas, which is outputted from an internal combustion engine of a vehicle (e.g., an automobile), to an intake passage (also referred to an intake side) of the internal combustion engine as an EGR gas to mix the EGR gas into intake air that flows in the intake passage.

The EGR apparatus includes at least an EGR valve unit 2 that opens and closes an EGR passage (an example of a passage) that recirculates the portion of the exhaust gas from the exhaust passage to the intake passage, and the EGR valve unit 2 adjusts an opening degree of the EGR passage. The EGR valve unit 2 is controlled by an electronic control unit (ECU) 3, which is also referred to as a control device.

The EGR valve unit 2 may be a high pressure EGR valve unit, which recirculates the EGR gas to a high negative pressure generating region (a downstream region located on a downstream side of a throttle valve in a flow direction of the intake air) in the intake passage. Alternatively, the EGR valve unit 2 may be a low pressure EGR valve unit, which recirculates the EGR gas to a low negative pressure generating region (an upstream region, which is located on an upstream side of the throttle valve in the flow direction of the intake air, while the upstream region may be located on, for example, an upstream side of a compressor in a case of a vehicle having a turbocharger) in the intake passage.

Figure 1:
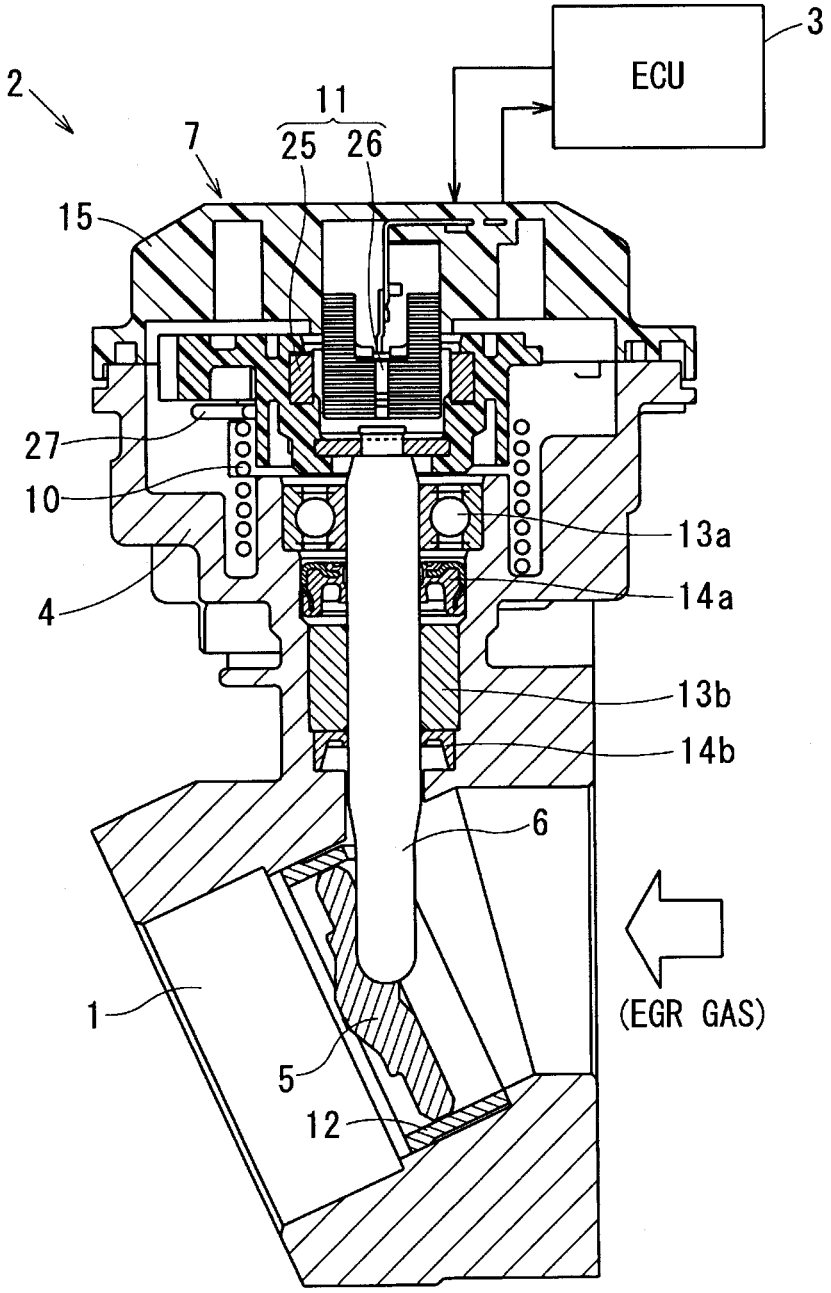
FIG. 1 is a cross-sectional view of an EGR valve according to an embodiment of the present disclosure.

A specific example of the EGR valve unit 2 will be described with reference to FIGS. 1 and 2.

In the following discussion, an upper side and a lower side of FIG. 1 will be described as an upper side and a lower side, respectively, for the purpose of easy understanding and should not be limitedly understood as an actual upper side and an actual lower side of the EGR valve unit 2 in an installed state of the EGR valve unit 2 on the vehicle.

The EGR valve unit 2 includes a housing 4, a valve 5, a shaft 6 and an electric actuator 7. The housing 4 forms a portion of the EGR passage 1 in an inside of the housing 4. The valve 5 is placed in the EGR passage 1. The shaft 6 supports the valve 5. The electric actuator 7 applies a rotational force to the shaft 6.

The electric actuator 7 includes an electric motor 8, a speed reducing gear device 9, a return spring 10 and an opening degree sensor 11. The electric motor 8 generates a rotational force (rotational output) when the electric motor 8 is energized. The speed reducing gear device 9 conducts a rotational torque of the electric motor 8 to the shaft 6 while amplifying the rotational torque of the electric motor 8. The return spring 10 urges the valve 5 only in a valve closing direction of the valve 5 (i.e., a direction for closing the valve 5) through the shaft 6. The opening degree sensor 11 senses an opening degree of the valve 5 through the shaft 6.

In the following discussion, a specific example of each corresponding component discussed above will be described.

The housing 4 is a die-cast product made of an aluminum alloy. A nozzle 12 is securely installed to an inner peripheral wall of the EGR passage 1, which is formed in the inside of the housing 4. The nozzle 12 is configured into a cylindrical tubular body and is made of a heat resistant and corrosion resistant material (e.g., stainless steel). An inner peripheral wall of the nozzle 12 forms a part of the inner peripheral wall of the EGR passage 1 formed in the inside of the housing 4.

The valve 5 is a butterfly valve, which is configured into a generally circular disk form. The valve 5 can open and close the EGR passage 1 in response to a rotational position of the shaft 6 and can adjust an opening area of the EGR passage 1 (inside of the nozzle 12). The valve 5 adjusts the EGR amount, i.e., the amount of the EGR gas that is returned to the intake passage in response to the opening degree of the valve 5.

The valve 5 is a ringless valve (also referred to a seal-ringless valve). The ringless valve is defined as a valve that does not have a separate seal ring, which is formed separately from the rest of the valve, in an outer peripheral edge portion of the valve.

The shaft 6 rotatably supports the valve 5 in the inside of the EGR passage 1. The shaft 6 of the present embodiment is configured such (but not limited to) that the valve 5 is cantilevered by the shaft 6, and an axis of the shaft 6 is tilted relative to a diametric direction of the valve 5.

The valve 5 is fixed to a lower end part of the shaft 6, and the valve 5 is rotated integrally with the shaft 6. A technique for joining between the valve 5 and the shaft 6 is not limited to any particular one. For instance, the valve 5 and the shaft 6 may be joined together by, for example, welding or a screw(s).

The shaft 6 is rotatably supported by two bearings (also referred to as first and second bearings) 13*a*, 13*b*, which are installed in a portion of the housing 4, which is located on an upper side of the EGR passage 1. Each bearing 13*a*, 13*b* may be a rolling bearing (e.g., a ball bearing, a roller bearing) or a plain bearing (e.g., a metal bearing). The bearings 13*a*, 13*b* are fixed in a bearing receiving hole formed in the housing 4 by, for instance, press-fitting, so that the bearings 13*a*, 13*b* rotatably support the shaft 6, which is inserted through the bearings 13*a*, 13*b*.

Furthermore, two seal members (also referred to as first and second seal members) 14*a*, 14*b*, which limit leakage of the EGR gas, are placed between the shaft 6 and the housing 4. The locations of the seal members 14*a*, 14*b* and the arrangements (e.g., use of a bearing having a seal function as the seal member) of the seal members 14*a*, 14*b* are not limited to any particular ones.

The electric actuator 7 is installed to the housing 4. A detachable cover 15 is installed to an upper part of the housing 4 with screws (serving as fixing elements or fixing means).

The electric motor 8 is received in a motor receiving chamber formed in the housing 4. The speed reducing gear device 9 and the return spring 10 are received in a space, which is formed between the housing 4 and the cover 15.

A rotational direction of the electric motor 8 is switchable between a normal rotational direction and a reverse rotational direction, which are opposite to each other, by switching a flow direction of an electric current supplied to coils of the electric motor 8. The electric motor 8 is formed as a direct current motor of a known type, which generates the rotational torque (rotational force) according to the amount of electric power supplied to the electric motor 8. After the installation of the electric motor 8 into the motor receiving chamber, the electric motor 8 is fixed to the housing 4 with screws 16 (serving as fixing elements or fixing means).

The speed reducing gear device 9 reduces a speed of the rotation outputted from the electric motor 8 through a plurality of gears and outputs the rotation of the reduced speed (amplified rotational torque) to the shaft 6. The gears of the speed reducing gear device 9 include a motor gear (pinion gear) 21, an intermediate gear 22 and a final gear (a gear rotor) 23. The motor gear 21 is rotatable integrally with the electric motor 8. The intermediate gear 22 is rotated by the motor gear 21. The final gear 23 is rotated by the intermediate gear 22. The final gear 23 is rotatable integrally with the shaft 6.

The motor gear 21 is an externally toothed gear that is fixed to an output shaft of the electric motor 8 and has a small outer diameter.

The intermediate gear 22 is a dual gear, which has a large diameter gear 22*a* and a small diameter gear 22*b* that are coaxially formed. The intermediate gear 22 is rotatably supported by a support shaft 24 that is supported by the housing 4 and the cover 15. The large diameter gear 22*a* is always engaged with the motor gear 21, and the small diameter gear 22*b* is always engaged with the final gear 23.

The final gear 23 is an externally toothed gear that has a large diameter and includes a fixation plate, which is insert molded in the final gear 23 and is fixed to an end part of the shaft 6 by, for example, swaging (plastic deformation). The external teeth of the final gear 23 are provided only in a range that is involved in the rotation of the valve 5. The rotational torque is transmitted through the motor gear 21, the large diameter gear 22*a*, the small diameter gear 22*b* and the final gear 23 in this order while amplifying the rotational torque and reducing the rotational speed, and this amplified torque is transmitted to the shaft 6.

The opening degree sensor 11 is a throttle position sensor, which senses the opening degree of the valve 5 by sensing the rotational angle of the shaft 6. The opening degree sensor 11 outputs an opening degree signal, which corresponds to the opening degree of the shaft 6 (the opening degree of the valve 5).

A specific example of the opening degree sensor 11 is a magnetic sensor, which senses relative rotation between two members in a contactless manner. The opening degree sensor 11 includes a magnetic circuit portion 25 and a magnetic sensing portion 26. The magnetic circuit portion 25 is configured into a tubular form that is insert molded in the final gear 23 and is rotatable integrally with the shaft 6. The magnetic sensing portion 26 is attached to the cover 15 and is contactless relative to the magnetic circuit portion 25. A voltage signal (an output signal of a Hall IC), which is generated at the magnetic sensing portion 26, is supplied to the ECU 3.

A specific example of the return spring 10 is a single spring, which is made of a coil spring that is wound only in one direction. As shown in FIG. 1, the return spring 10 is coaxially placed around the shaft 6.

The return spring 10 is installed between the housing 4 and the final gear 23 and generates a spring force. An upper hook 27 and a lower hook 28, which are radially outwardly projected, are formed at two end parts, respectively, of the return spring 10.

The upper hook 27 is urged against and is installed to an upper hook contact portion 29, which is formed in the final gear 23. The lower hook 28 is urged against and is installed to a lower hook contact portion 30, which is formed in the housing 4. Thereby, the return spring 10 exerts the spring force to urge the valve 5 only in the valve closing direction.

The EGR valve unit 2 includes a mechanical stopper (or simply referred to as a stopper) 31, which maintains the valve 5 at a full closing degree θ0 when the electric actuator 7 is stopped.

The mechanical stopper 31 mechanically limits a rotatable limit of the valve 5 in the valve closing direction. The mechanical stopper 31 includes an abuttable portion of a rotatable member and an abuttable portion of a fixed member, which are abuttable to each other.

Figure 2:
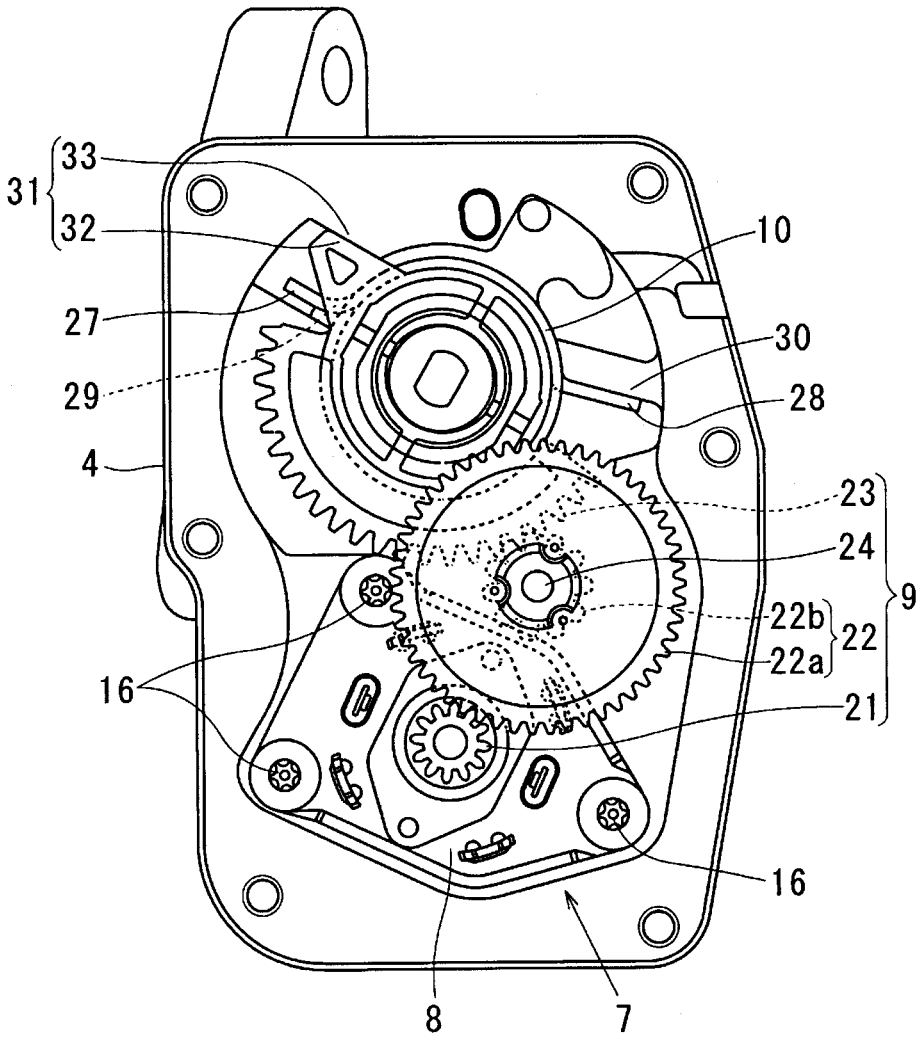
FIG. 2 is a descriptive view of an electric actuator of the present embodiment, from which a cover is removed for the descriptive purpose.

With reference to FIG. 2, a specific example of the mechanical stopper 31 includes a stopper projection (stopper lever) 32, which is formed in the final gear 23 and radially outwardly projects, and a step surface 33, which is formed in an inner wall of the housing 4 (a receiving wall that receives, for example, the final gear 23). The stopper projection 32 and the step surface 33 serve as the abuttable portions, respectively, which are abuttable with each other. When the valve 5 is rotated in the valve closing direction, the stopper projection 32 abuts against the step surface 33. Thereby, the valve 5 is stopped at the full closing degree θ0 (the opening degree of zero degrees, which is the full closing position).

The ECU 3 is an electronic control unit of a known type, which includes a microcomputer. The ECU 3 executes a feedback control operation of the electric motor 8 such that a sensed opening degree of the valve 5 (an actual opening degree of the valve 5), which is sensed with the opening degree sensor 11, becomes a target opening degree, which is computed based on an operational state of the engine (e.g., a rotational speed of the engine, an opening degree of an accelerator).

The feedback control operation is a known operation and changes the sensed opening degree (the actual opening degree of the valve 5), which is sensed with the opening degree sensor 11, to coincide with the target opening degree through use of a feedback control technique, such as a proportional-integral-derivative (PID) control.

When the valve 5, which is in a valve open state, is fully closed, the ECU 3 executes the feedback control operation of the electric motor 8 such that the sensed opening degree of the valve 5, which is sensed with the opening degree sensor 11, approaches the target opening degree θb, which is set for the time of fully closing the valve 5. The ECU 3 stops the energization of the electric motor 8 after reaching of the sensed opening degree of the valve 5, which is sensed with the opening degree sensor 11, to an energization stop opening degree (also referred to as a power supply stop opening degree) θa, which is set on a valve opening side of the full closing degree θ0 of the valve 5 in a valve opening direction of the valve 5 (i.e., a direction for opening the valve 5).

That is, as shown in FIGS. 3A and 3B, at the time of fully closing the valve 5, which is in the valve open state, the ECU 3 controls the energization of the electric motor 8 such that the electric motor 8 is rotated in the valve closing direction until the sensed opening degree of the valve 5, which is sensed with the opening degree sensor 11, reaches the energization stop opening degree θa, which is set on the valve opening side of the full closing degree θ0 of the valve 5 in the valve opening direction of the valve 5, so that the approaching of the valve 5 to the full closing degree θ0 of the valve 5 is accelerated. Then, the ECU 3 stops the energization of the electric motor 8 after the ECU 3 determines that the sensed opening degree of the valve 5, which is sensed with the opening degree sensor 11, has reached the energization stop opening degree θa, so that the valve 5 is returned to the full closing degree θ0 of the valve 5 by the urging force of the return spring 10.

Furthermore, at the time of fully closing the valve 5 in the valve open state, the ECU 3 sets the target opening degree θb, which is set for the time of fully closing the valve 5, to a corresponding angle, which is located on the valve closing side of the energization stop opening degree θa in the valve closing direction. This setting of the target opening degree θb serves as the measures (or means), which accelerate the valve closing speed of the valve 5.

Here, the target opening degree θb, which is set for the time of fully closing the valve 5, is set to the corresponding angle, which does not cause collision of the mechanical stopper 31, or is set to the corresponding angle, which limits the collision speed of the mechanical stopper 31 to a low speed that is equal to or lower than 50 degrees/second at the time of executing the full closing control operation (the operation of fully closing the valve 5) with the ECU 3.

In order to assist the understanding, a specific value of the energization stop opening degree θa and a specific value of the target opening degree θb, which is set for the time of fully closing the valve 5, will be described. In the following discussion, the full closing degree θ0 of the valve 5 (0 degrees, i.e., zero degrees, which is achieved when the valve 5 is held such that a plane of the valve 5 is perpendicular to the inner wall of the passage that is opened or closed with the valve 5) is defined as a reference angle. For the descriptive purpose, it is assumed that one side (valve opening side) of the full closing degree θ0 of the valve 5 in the valve opening direction is defined as a positive side (a positive angular range), and an opposite side (valve closing side) of the full closing degree θ0 of the valve 5, which is opposite from the one side of the full closing degree θ0 of the valve 5 in the valve closing direction, is defined as a negative side (a negative angular range).

In this embodiment, the energization stop opening degree θa is set to be +5 degrees. In such a case, the target opening degree θb, which is set for the time of fully closing the valve 5, is set to be a value (including a negative value) that is smaller than +5 degrees.

In this embodiment, as a specific example, the target opening degree θb, which is set for the time of fully closing the valve 5, is set to be on the negative side of the full closing degree θ0 of the valve 5. As an exemplary numeric value, the target opening degree θb, which is set for the time of fully closing the valve 5, is set to be −5 degrees.

The numeric values (the energization stop opening degree θa=+5 degrees, and the target opening degree θb=−5 degrees) indicated in this embodiment are mere examples used for the purpose of assisting the understanding, and the present disclosure is not necessarily limited to these values.

The energization stop opening degree θa and the target opening degree θb should be appropriately changed according to, for example, the setting of the gain used in the feedback control operation and/or the spring force of the return spring 10. The target opening degree θb, which is set for the time of fully closing the valve 5, is not necessarily limited to the negative opening degree. That is, the target opening degree θb, which is set for the time of fully closing the valve 5, may possibly be a positive opening degree, which is located on the valve closing side of the energization stop opening degree θa, or alternatively be zero degrees (i.e., 0 degrees).

(First Advantage of Embodiment)

In this embodiment, as discussed above, the target opening degree θb, which is set for the time of fully closing the valve 5, is set to be on the valve closing side of the energization stop opening degree θa, so that the time, which is required for the valve 5 to reach the energization stop opening degree θa, can be shortened.

Furthermore, after reaching of the energization stop opening degree θa, an inertial force of the electric actuator 7 in the valve closing direction can be used to shorten the time, which is required to approach the full closing degree θ0 of the valve 5.

When the valve 5 approaches the full closing degree θ0 of the valve 5, the force of the return spring 10 becomes small, and the urging force, which is applied from the return spring 10 to the valve 5, is weakened. As a result, the speed at the time of abutment of the mechanical stopper 31 is limited, so that the collision of the mechanical stopper 31 is limited.

As discussed above, at the time of fully closing the valve 5, which is in the valve open state, the EGR apparatus of the present embodiment can improve the response at the time of fully closing the valve 5 while limiting the collision of the mechanical stopper 31.

(Second Advantage of Embodiment)

In this embodiment, as discussed above, the target opening degree θb, which is set for the time of fully closing the valve 5, is set on the negative side of the full closing degree θ0 of the valve 5.

Therefore, at the time of fully closing the valve 5, which is in the valve open state, the difference between the target opening degree θb, which is set for the time of fully closing the valve 5, and the sensed opening degree of the valve 5 is increased, and the drive force of the electric motor 8 generated in the feedback control operation is increased. As a result, the time, which is required to reach the energization stop opening degree θa, can be shortened, and thereby the response at the time of fully closing the valve 5 can be improved.

(Third Advantage of Embodiment)

As discussed above, the valve 5 of the present embodiment is the ringless valve, which does not have the separate seal ring in the outer peripheral edge portion of the valve 5.

In the case where the seal ring is used in the valve, an increase in the number of the components and an increase in the required steps for forming a seal groove, which receives the seal ring, cause increased costs, and the seal ring may possibly be damaged by friction or an external force. However, when the ringless valve is used, the reduction of the costs of the EGR valve unit 2 and the improvement in the robustness of the EGR valve unit 2 are possible.

(Fourth Advantage of Embodiment)

As discussed above, the mechanical stopper 31 of the present embodiment includes the abuttable portion, i.e., the stopper projection 32 of the final gear 23 of the speed reducing gear device 9 and the abuttable portion, i.e., the step surface 33 of the housing 4. When the stopper projection 32 abuts against the step surface 33, the valve 5 is stopped at the full closing degree θ0. With this construction, even in the state where the energization of the electric motor 8 is stopped, the valve closed state is maintained. Therefore, the deterioration of the engine startability in the energization stop state of the electric motor 8 is avoided.

Furthermore, even in a case where the energization of the electric motor 8 cannot be implemented due to some reason, the valve 5 is returned to the full closing degree 60 by the urging force of the return spring 10. Thus, even in the case of occurrence of the unexpected malfunction, the good combustion state of the engine can be maintained.

Now, modifications of the above embodiment will be described.

In the above embodiment, as the example of the mechanical stopper 31, the stopper projection 32 is provided in the final gear 23. However, the location of the mechanical stopper 31 is not limited to the final gear 23, and the mechanical stopper 31 can be any other suitable mechanism (means), which mechanically limits the rotational limit of the valve 5 in the valve closing direction.

In the above embodiment, the present disclosure is applied to the valve apparatus, in which the valve 5 is rotated. However, the present disclosure is not limited to such a valve apparatus. For instance, the present disclosure may be applied to a valve apparatus of a poppet type, in which a valve linearly slides in a predetermined direction (e.g., an exhaust gas recirculation apparatus that uses a poppet valve).

In the above embodiment, the present disclosure is applied to the exhaust gas recirculation apparatus. However, the intended use of the valve apparatus of the preset disclosure is not limited to such one. For example, the present disclosure may be applied to any other suitable valve apparatus, such as a waste gate valve, or an exhaust gas throttling valve.

What is claimed is:

1. A valve apparatus comprising:

a valve that is closable, wherein the valve opens or closes a passage;

an opening degree sensor that senses an opening degree of the valve;

an electric actuator that drives the valve with an electric motor, which generates a rotational output when the electric motor is energized;

a control device that executes a feedback control operation of the electric motor such that when the valve, which is in a valve open state, is fully closed, a sensed opening degree of the valve, which is sensed with the opening degree sensor, approaches a target opening degree, which is set for a time of fully closing the valve, wherein the control device stops the energization of the electric motor after reaching of the sensed opening degree of the valve, which is sensed with the opening degree sensor, to an energization stop opening degree, which is set on a valve opening side of a full closing degree of the valve in a valve opening direction of the valve;

a return spring that urges the valve in a valve closing direction of the valve; and a mechanical stopper that mechanically stops the valve at the full closing degree, wherein the target opening degree, which is set for the time of fully closing the valve, is set on a valve closing side of the energization stop opening degree in the valve closing direction;

the valve opening side of the full closing degree of the valve is defined as a positive side, and a valve closing side of the full closing degree of the valve, which is opposite from the valve opening side of the full closing degree of the valve in the valve closing direction, is defined as a negative side; and the target opening degree, which is set for the time of fully closing the valve, is set to be on the negative side of the full closing degree of the valve.

2. The valve apparatus according to claim 1, wherein the valve is a ringless valve that does not have a separate seal ring in an outer peripheral edge portion of the valve.

3. The valve apparatus according to claim 1, wherein the mechanical stopper includes:

an abuttable portion of a final gear of a speed reducing gear device of the electric actuator; and an abuttable portion of a housing, which receives the electric actuator, wherein the abuttable portion of the final gear is abuttable against the abuttable portion of the housing.

4. The valve apparatus according to claim 1, wherein the valve apparatus is an exhaust gas recirculation (EGR) apparatus, which recirculates a portion of exhaust gas outputted from an internal combustion engine as an EGR gas to an intake side of the internal combustion engine.

* * * * *